US011707418B2

(12) United States Patent
Heynes et al.

(10) Patent No.: US 11,707,418 B2
(45) Date of Patent: Jul. 25, 2023

(54) CONNECTOR FOR A GASTROSTOMY DEVICE

(71) Applicant: Metis Design BV, Amsterdam (NL)

(72) Inventors: Mark David Heynes, Staffordshire (GB); Phil Anthony Sampey, Cheshire (GB); William Charles Morris, Staffordshire (GB); Lee Thomas Smith, Stafford (GB)

(73) Assignee: Metis Design BV, Amsterdam (NL)

( * ) Notice: Subject to any disclaimer, the term of this patent is extended or adjusted under 35 U.S.C. 154(b) by 300 days.

(21) Appl. No.: 16/878,716

(22) Filed: May 20, 2020

(65) Prior Publication Data

US 2020/0368115 A1 Nov. 26, 2020

(30) Foreign Application Priority Data

May 20, 2019 (GB) ..... 1907070

(51) Int. Cl.
*A61J 15/00* (2006.01)

(52) U.S. Cl.
CPC ..... *A61J 15/0026* (2013.01); *A61J 15/0015* (2013.01); *A61J 15/0092* (2013.01)

(58) Field of Classification Search
CPC ..... A61J 15/0026; A61J 15/0015; A61J 15/0092; A61M 39/22; A61M 2005/1586; A61M 5/32
See application file for complete search history.

(56) References Cited

U.S. PATENT DOCUMENTS 5,096,232 A 3/1992 Fond et al.
5,688,254 A 11/1997 Lopez et al.
(Continued)

FOREIGN PATENT DOCUMENTS

AU 2016200152 B2 3/2017
CN 108386424 A 8/2018
(Continued)

OTHER PUBLICATIONS

CA Search Report for Application No. GB2007412.6 dated Nov. 18, 2020.
(Continued)

*Primary Examiner* — Manuel A Mendez
(74) *Attorney, Agent, or Firm* — Harness, Dickey & Pierce, P.L.C.

(57) ABSTRACT

A connector for rotatably coupling an enteral feeding solution supply tube to a circular port of a gastrostomy device wherein the connector comprises a fluid conduit having a first end configured for connection with an orifice defined in the circular port to supply the enteral feeding solution to the gastrostomy device, and a second end configured for connection to the enteral feeding solution supply tube, a pair of arms circumferentially arranged around an outer wall of the first end of the fluid conduit, each arm including a first free end and a second free end, wherein the second free end includes a catch configured to releasably engage with a circumferential rim on the circular port, and a flexible bridge connecting each arm to the first end of the fluid conduit and about which the first and second ends of each arm can be pivoted, wherein the connector is couplable to and decouplable from the circular port by pivoting the first and second ends of each arm at the flexible bridge such that the catch on the second free end of each arm is radially displaced into engagement or out of engagement with the rim.

5 Claims, 10 Drawing Sheets

(56) References Cited

U.S. PATENT DOCUMENTS

| | | | | |
|---|---|---|---|---|
| D418,220 | S | 12/1999 | Picha et al. | |
| 5,997,503 | A | 12/1999 | Willis et al. | |
| 6,019,746 | A | 2/2000 | Picha et al. | |
| 6,217,564 | B1 | 4/2001 | Peters et al. | |
| 6,419,670 | B1 | 7/2002 | Dikeman | |
| 8,789,854 | B2 * | 7/2014 | Christian, Jr. | F16L 37/082 285/39 |
| D783,160 | S | 4/2017 | Griffith | |
| D783,161 | S | 4/2017 | Griffith | |
| D783,162 | S | 4/2017 | Griffith | |
| 10,004,889 | B2 | 6/2018 | Silver | |
| 10,058,693 | B2 | 8/2018 | Phillips et al. | |
| 2002/0153012 | A1 | 10/2002 | Gunaratnam et al. | |
| 2003/0045841 | A1 | 3/2003 | Palcisko et al. | |
| 2004/0035419 | A1 | 2/2004 | Serowski et al. | |
| 2005/0090805 | A1 | 4/2005 | Shaw et al. | |
| 2012/0029483 | A1 * | 2/2012 | Griffith | A61M 39/1011 604/535 |
| 2014/0155839 | A1 | 6/2014 | Griffith et al. | |
| 2014/0155866 | A1 | 6/2014 | Griffith et al. | |
| 2014/0188087 | A1 | 7/2014 | Griesbach, III | |
| 2015/0335874 | A1 | 11/2015 | Phillips et al. | |
| 2018/0015259 | A1 | 1/2018 | Kirn et al. | |
| 2018/0064923 | A1 | 3/2018 | Takeuchi | |

FOREIGN PATENT DOCUMENTS

| | | | |
|---|---|---|---|
| DE | 102013001631 | A1 | 7/2014 |
| EP | 0404361 | A1 | 12/1990 |
| EP | 0541515 | A1 | 5/1993 |
| EP | 1345648 | B1 | 9/2006 |
| EP | 1292261 | B1 | 1/2008 |
| EP | 1888962 | A2 | 2/2008 |
| EP | 1817068 | B1 | 7/2008 |
| EP | 1235542 | B1 | 3/2009 |
| EP | 2219584 | B1 | 8/2010 |
| EP | 2310735 | A1 | 4/2011 |
| EP | 2245354 | B1 | 6/2012 |
| EP | 2598188 | A1 | 6/2013 |
| EP | 11746318 | A | 6/2013 |
| EP | 2379155 | B1 | 12/2013 |
| EP | 2497525 | B1 | 6/2014 |
| EP | 2837403 | A1 | 2/2015 |
| EP | 2837404 | A1 | 2/2015 |
| EP | 1161273 | B1 | 4/2015 |
| EP | 2925243 | B1 | 10/2015 |
| EP | 2925400 | A1 | 10/2015 |
| EP | 2516916 | B1 | 11/2015 |
| EP | 2943243 | A1 | 11/2015 |
| EP | 2968816 | B1 | 1/2016 |
| EP | 2654661 | B1 | 4/2016 |
| EP | 2515825 | B1 | 6/2016 |
| EP | 2872103 | B1 | 8/2016 |
| EP | 3065811 | B1 | 9/2016 |
| EP | 3079754 | B1 | 1/2017 |
| EP | 2793797 | B1 | 2/2017 |
| EP | 2808052 | B1 | 2/2017 |
| EP | 3122264 | B1 | 2/2017 |
| EP | 3145572 | B1 | 3/2017 |
| EP | 3202455 | A1 | 8/2017 |
| EP | 2968866 | B1 | 12/2017 |
| EP | 2938315 | B1 | 2/2018 |
| EP | 3307350 | A1 | 4/2018 |
| EP | 2999512 | B1 | 12/2018 |
| EP | 3270869 | B1 | 2/2019 |
| EP | 3228337 | B1 | 3/2019 |
| GB | 2519530 | A | 4/2015 |
| JP | H-09152080 | A | 6/1997 |
| JP | 2005058638 | A | 3/2005 |
| JP | 2006141714 | A | 6/2006 |
| JP | 2012075495 | A | 4/2012 |
| JP | 2017108902 | A | 6/2017 |
| JP | 2019088914 | A | 6/2019 |
| WO | WO-02066108 | A1 | 8/2002 |
| WO | WO-03020361 | A2 | 3/2003 |
| WO | WO-2004091692 | A2 | 10/2004 |
| WO | WO-08113477 | A1 | 9/2008 |
| WO | WO-09106301 | A2 | 9/2009 |
| WO | WO-10075032 | A2 | 7/2010 |
| WO | WO-2012014118 | A1 | 2/2012 |
| WO | WO-14021271 | A1 | 2/2014 |
| WO | WO-2014/083468 | A1 | 6/2014 |
| WO | WO-2014/083471 | A1 | 6/2014 |
| WO | WO-14150225 | A1 | 9/2014 |
| WO | WO-2014188372 | A1 | 11/2014 |
| WO | WO-15069631 | A1 | 5/2015 |
| WO | WO-15123689 | A1 | 8/2015 |
| WO | WO-2015179094 | A1 | 11/2015 |
| WO | WO-16018998 | A1 | 2/2016 |
| WO | WO-16057794 | A1 | 4/2016 |
| WO | WO-17004265 | A1 | 1/2017 |
| WO | WO-17011641 | A1 | 1/2017 |
| WO | WO-17123907 | A2 | 7/2017 |

OTHER PUBLICATIONS

Search Report for Application No. GB1907070.5 dated Nov. 13, 2019.

European Search Report from Application No. 20175499.1 dated Sep. 15, 2020.

* cited by examiner

CONNECTOR FOR A GASTROSTOMY DEVICE

CROSS REFERENCE TO RELATED APPLICATIONS

This application claims the benefit and priority of GB1907070.5, filed May 20, 2019. The entire disclosure of the above application is incorporated herein by reference.

FIELD OF THE INVENTION

The invention relates to a connector for connection of an enteral feeding solution supply tube to a gastrostomy device, and methods of use thereof.

BACKGROUND TO THE INVENTION

Many patients are incapable of taking nourishment in the conventional fashion. This might be as a result of a pathology or surgery. The process of feeding a patient by the use of an enteral feeding device is well known in the art. Typically, a gastrostomy device is implanted in a patient's stomach wall. The gastrostomy device is then connected via a connector or adapter to an enteral feeding tube. Nutritional fluids are then transported via the gastrostomy device into the patient's stomach.

One of the common problems associated with this process is that the feeding tube and adapter may become accidentally disengaged from the gastrostomy device during the course of feeding, and thus the flow of nutritional fluids to the patient is interrupted.

There is a need for an improved connector for retaining a feeding tube and gastrostomy device in an interlocked position relative to one another.

SUMMARY OF THE INVENTION

According to a first aspect of the invention there is provided a connector for rotatably coupling an enteral feeding solution supply tube to a circular port of a gastrostomy device, the connector comprising:

a fluid conduit having a first end configured for connection with an orifice defined in the circular port to supply the enteral feeding solution to the gastrostomy device, and a second end configured for connection to the enteral feeding solution supply tube, a pair of arms circumferentially arranged around an outer wall of the first end of the fluid conduit, each arm including a first free end and a second free end, wherein the second free end includes a catch configured to releasably engage with a circumferential rim on the circular port, and a flexible bridge connecting each arm to the first end of the fluid conduit and about which the first and second ends of each arm can be pivoted, wherein the connector is couplable to and decouplable from the circular port by pivoting the first and second ends of each arm at the flexible bridge such that the catch on the second free end of each arm is radially displaced into engagement or out of engagement with the rim.

The design of the connector enables the connector to be securely connected to circular port of the gastrostomy device, whilst also allowing rotation of the connector about the port. The gastrostomy device is often referred to in the art as a "button". The circular port is often referred to in the art as an "interlock".

In some constructions of the connector, the outer wall of the first end of the fluid conduit and an inner wall of each arm are substantially parallel. This allows the arm to pivot and reduces the distance that the arm needs to travel during engagement and disengagement from the rim of the interlock. Accordingly, this puts less stress on the material from which the arm is formed, and minimises the risk of breakage.

In some constructions of the connector the catch is located on the inner wall of the arm. The catch may be defined by a ledge that projects inwardly towards the first end of the fluid conduit. The ledge may have a rim contacting surface configured to releasably engage with a ledge contacting surface of the circumferential rim.

In some constructions, the ledge contacting surface of the rim is a sloped surface, and the rim contacting surface of the ledge has a complementary sloped surface. This design improves the retention of the catch against the underside of the ledge contacting surface of the circumferential rim by creating a hook effect.

It is desirable that the connector is not disengaged from the gastrostomy device during the feeding process. Accordingly, the connector as defined herein may further comprise a locking member at least a part of which is configured to be sandwiched between the outer wall of the fluid conduit and the inner wall of each arm to prevent inadvertent pivoting of each arm when the connector is coupled to the port of the gastrostomy device.

In some constructions, the lock member comprises a pair of hooks configured to hook around at least part of each flexible bridge. For example, each hook may be configured to hook underneath each flexible bridge.

The lock member may further comprise a hinge about which the hooks can be pivoted into and out of engagement with each flexible bridge. For example, in some constructions wherein the second end of the fluid conduit is substantially perpendicular to the first end of the fluid conduit, wherein the lock member comprises:

a collar for connecting the lock member to the second end of the fluid conduit, and a cover portion hingedly attached to the collar, wherein a pair of hooks extend from the cover portion, and wherein the cover portion is biased such that the surface from which the hooks depend is substantially perpendicular to the second end of the fluid conduit.

The lock member may be removably attachable to the connector. For example, the collar of the lock member may comprise a closed ring that has an inner diameter that is slightly larger than the outer diameter of the second end of the connector. This enables the collar of the lock member to be slidably attached to the second end of the connector. In some other constructions, the collar of the lock member may comprise an open ring that is made of a resilient material. This enables the collar of the lock member to snap-fit about the second end of the connector.

According to a second aspect of the invention there is provided a feeding extension set, comprising an enteral feeding solution supply tube, a connector according to the first aspect of the invention, wherein the connector is configured for rotatably coupling the enteral feeding solution tube to a circular port of a gastrostomy device.

According to a third aspect of the invention there is provided a method of delivering an enteral fluid to a patient comprising the steps of:

(i) using a connector according to the first aspect of the invention, (ii) coupling the first end of the fluid conduit to the circular port of an indwelling gastrostomy device, (iii) coupling the second end of the fluid conduit to an enteral feeding solution supply tube.

The method may further comprise the step of positioning the pair of hooks on a lock member provided on the connector around at least part of each flexible bridge to prevent the second free end of each arm from decoupling from the circumferential rim. This prevent inadvertent decoupling of the connector from the gastrostomy device.

A connector used to connect a fluid conduit for transporting enteral feeding solution to a port on a gastrostomy device is conventionally provided with a non-return valve. This valve ensures that the enteral feeding solution only flows in one direction, i.e., into the gastrostomy device. Back-flow is prevented. An example of a non-return valve used within gastrostomy device is a duck-bill valve. A duckbill valve is a valve, generally manufactured from rubber or synthetic elastomer, and shaped like the beak of a duck. Such a valve is commonly used in medical applications to prevent contamination due to backflow.

A problem associated with existing connectors is that a user can inadvertently squeeze the exposed flange of a duck-bill valve. This squeezing results in the opening of the valve, resulting in back-flow. The present invention solves this problem by locating the non-return valve entirely within the connector. This prevents inadvertent inward deflection of the flange caused by the user.

Therefore, according to a fourth aspect of the invention there is provided a gastrostomy device comprising a circular port assembly for establishing a fluid connection with a source of an enteral feeding solution, wherein the circular port assembly comprises, a first component including:

a first circular wall member having an inner diameter, and a circumferential rim, a portion of which extends inwardly from the first circular wall member, a second component nested within the first component and including:

a second circular wall member having an outer diameter that is less than the inner diameter of the first circular wall member, wherein a gap is provided between a surface of the inwardly extending portion of the circumferential rim of the first component and an end portion of the wall member of the second component, and a non-return valve located within the second component, said valve having a flange, said flange being sandwiched within the gap provided between the surface of the inwardly extending circumferential rim of the first component and the end portion of the wall member of the second component to inhibit inward deflection of the flange by the user.

In some constructions of the gastrostomy device according to the fourth aspect of the invention, the non-return valve is a duckbill valve.

BRIEF DESCRIPTION OF THE DRAWINGS

Constructions of the present invention will be described hereinafter, by way of example only, with reference to the accompanying drawings in which like reference signs relate to like elements and in which:

FIGS. 1 to 6 illustrate a first construction of a connector 10 according to the first aspect of the invention. The connector includes a tubular fluid conduit having a first end 12 configured for connection with an orifice 102 defined in the circular port 104 of a gastrostomy device 100. The fluid conduit also includes a second end 14 configured for connection to an enteral feeding solution supply tube (not shown). In the construction shown, the fluid conduit is generally cylindrical and has a circular cross section. The first end 12 is substantially perpendicular to the second end 14. In other constructions, the fluid conduit is straight, such that the first end 12 and the second end 14 are in-line with each other.

Figure 1:
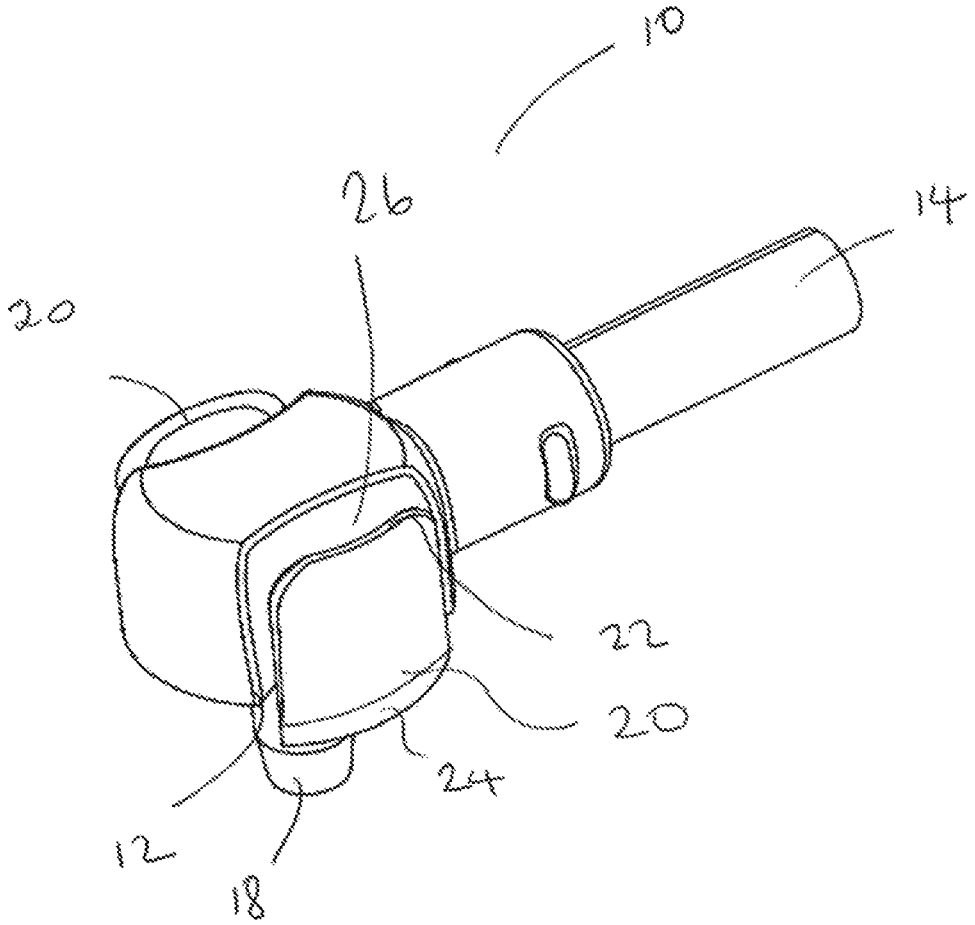
FIG. 1: Illustrates a perspective view of a first construction of a connector according to the invention for rotatably coupling an enteral feeding solution supply tube to a gastrostomy device.
Figure 2:
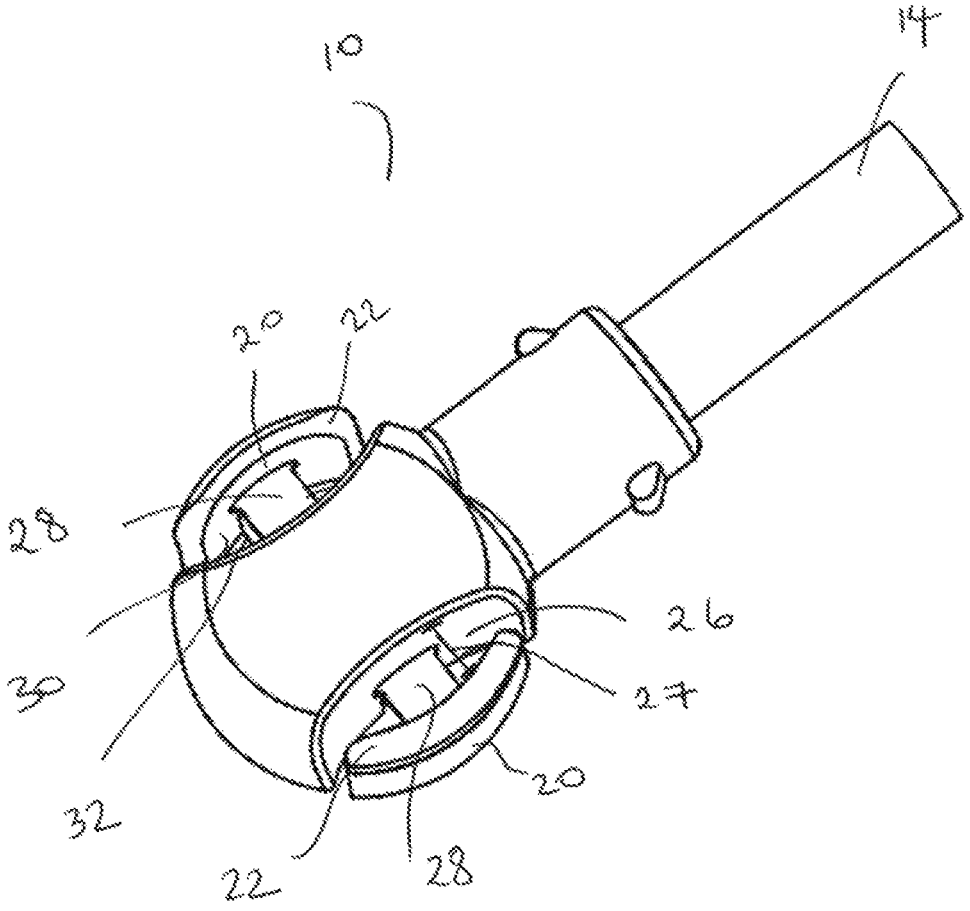
FIG. 2: Illustrates a top view of the first construction of the connector of FIG. 1.

In the construction shown, the first end 12 of the fluid conduit has a terminally-located orifice-connecting portion 18 that is nozzle-shaped or tapered. This portion forms a tapered connection with the inner surface of the orifice 102.

The connector includes a pair of arms 20 circumferentially arranged about the first end 12 of the conduit. In the construction shown, the arms are positioned on opposing sides of the first end 12 of the conduit. Each arm includes a first free end 22 and a second free end 24.

Each arm 20 is connected to the outer wall 26 of the first end 12 of the fluid conduit via a flexible bridge 28. This flexible bridge defines a pivot about which the first and second free ends of each arm can be pivoted. A gap 27 is defined between the outer wall 26 and the inner wall 30 of each arm.

Each arm is connected such that the terminally-located orifice-connecting portion 18 extends a distance beyond the second free end 24 of each arm, thereby enabling the terminally-located orifice-connecting portion 18 to be inserted into the orifice 102.

In the construction shown, the outer wall 26 of the first end of the fluid conduit and the inner wall 30 of each arm 20 are substantially parallel, in both the coupled and decoupled configurations.

The second free end 24 of each arm includes a catch 32 that is configured to releasably engage with a circumferential rim 106 extending about the circular port 104 of the gastrostomy device 100. The catch 32 in the construction shown is located on the inner wall 30 of each arm 20, and takes the form of a ledge that extends inwardly towards the outer wall of the first end of the fluid conduit. Each ledge has a rim-contacting surface 36 that is configured to releasably engage with a ledge-contacting surface 108 on the circumferential rim 106.

Figure 3:
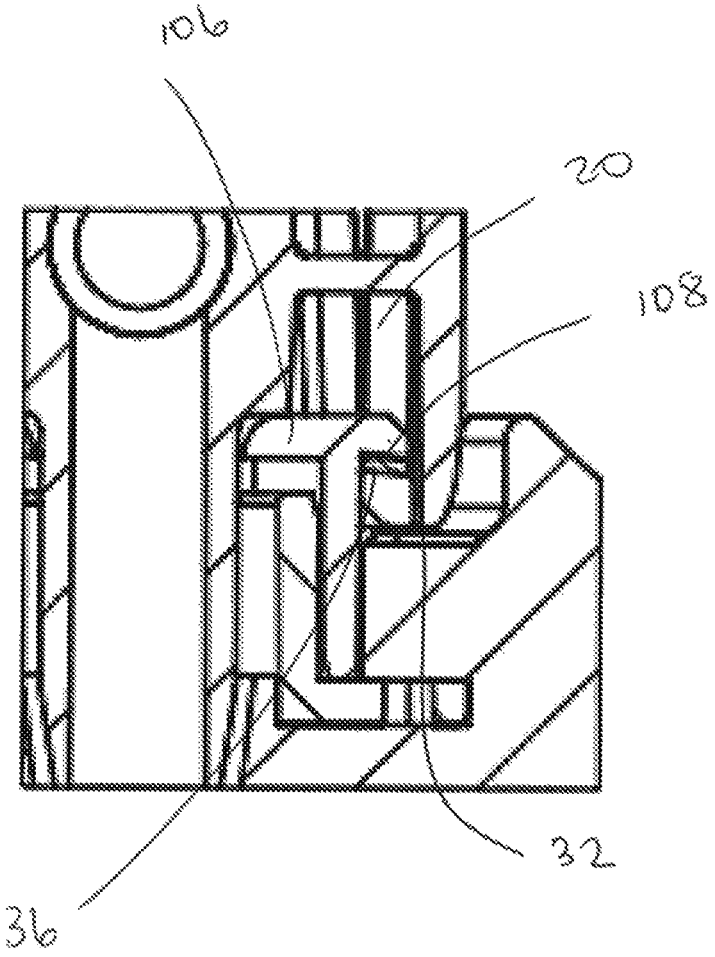
FIG. 3: Illustrates a cross-section of the first construction of the connector of FIG. 1 assembled on the circular port of the gastrostomy device.

Referring now to FIG. 3, in the construction of the connector shown, the rim-contacting surface 36 and the ledge-contacting surface 108 are provided with a corresponding angled surfaces. This creates a hook effect and improves the grip of the connector against the circumferential rim.

The connector 10 may be molded as a unitary component from a plastic.

The connector 10 is couplable to and decouplable from the circular port 104 by pivoting the first and second ends of each arm at the flexible bridge 28 such that the catch 32 on the second free end 24 of each arm is radially displaced into engagement or out of engagement with the circumferential rim 106.

Figure 4:
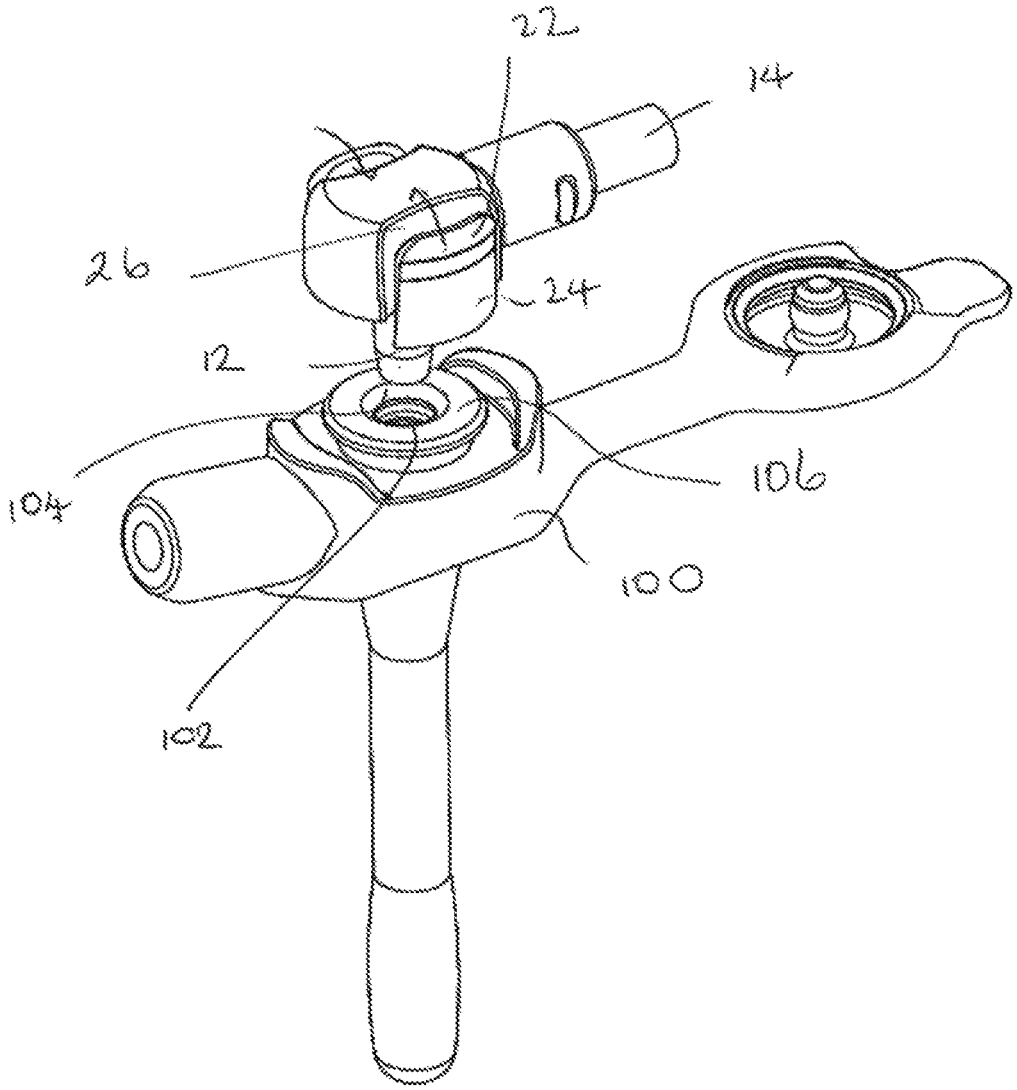
FIG. 4: Illustrates a schematic of the first construction of the connector and the gastrostomy device prior to coupling of the connector to the gastrostomy device.
Figure 5:
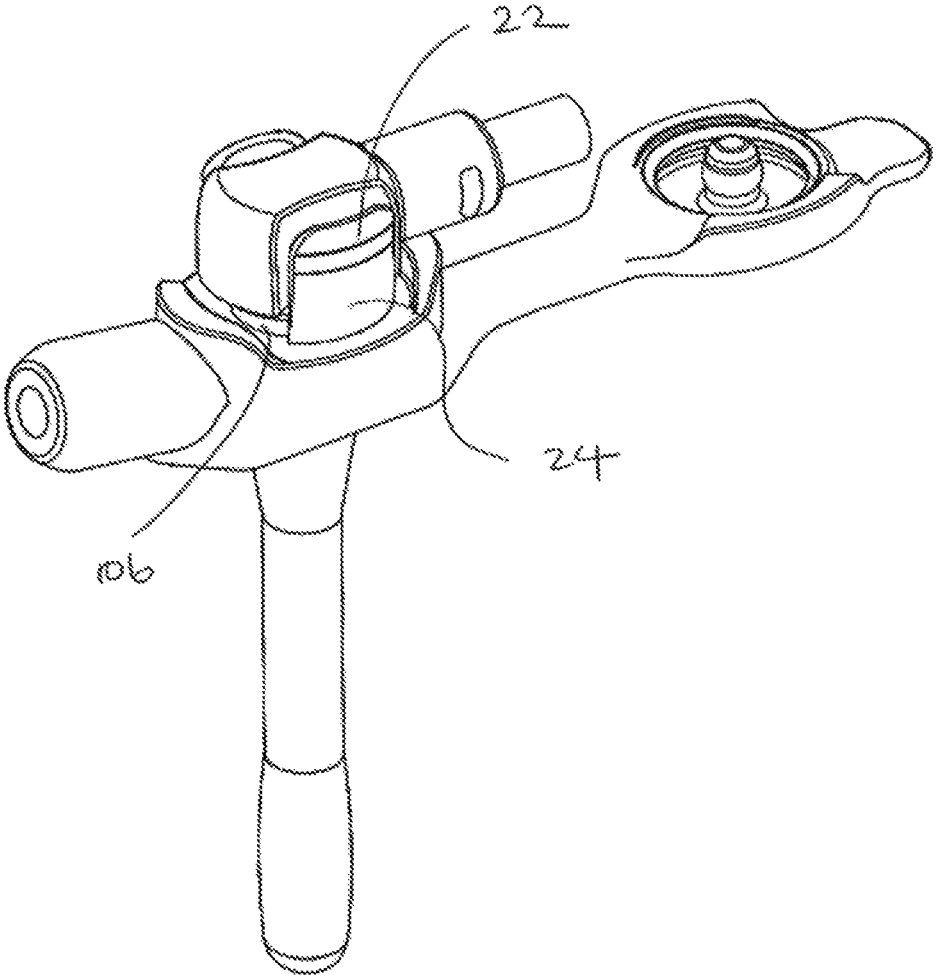
FIG. 5: Illustrates a schematic of the first construction of the connector and the gastrostomy device after coupling of the connector to the gastrostomy device.

In use, in order to couple the connector 10 to the circular port 104 of the gastrostomy device, a patient or caregiver may apply an inwardly directed pressure (e.g., applied by a pinching action using the thumb and forefinger) to the outer surfaces of each arm 20 in order to move the first free end 22 of each arm inwardly towards the outer wall 26 of the first end 12 of the fluid conduit. The direction of the applied pressure is indicated by the arrows in FIG. 4. As a consequence of the inward movement of the first free end 22 of each arm, the second free end 24 of each arm is pivoted about the flexible bridge 28 in an outwardly direction away from the outer wall 26 of the first end 12 of the fluid conduit. This outward movement enables the catch 32 on the inner wall 30 of the arm to clear the circumferential rim 106 as the connector is pushed into contact with the gastrostomy device. When the user releases the applied pressure, the second free end 24 of each arm reverts to its original position. Accordingly, the rim-contacting surface 36 of the ledge engages with the ledge-contacting surface 108 on the circumferential rim 106. This is shown in FIG. 5.

Alternatively, in order to couple the connector 10 to the circular port 104 of the gastrostomy device, a patient or caregiver may simply push the second free end 24 of each arm down against the circular port 104. The angled leading edges of the catches 32 then push and flex the free end 24 outwardly such that they clip over the circumferential rim 106 as the connector is pushed into contact with the gastrostomy device.

In order to decouple the connector 10 from the circular port 104 of the gastrostomy device, the patient or caregiver performs a similar pinching actions as outlined above in relation to coupling the connector. The user applies an inwardly directed pressure (e.g., applied by a pinching action between the thumb and forefinger) to the outer surfaces of each arm 20 in order to move the first free end 22 of each arm inwardly towards the outer wall 26 of the first end 12 of the fluid conduit. As a consequence, the second free end 24 of each arm is pivoted in an outwardly direction away from the outer wall 26 of the first end 12 of the fluid conduit. This outward movement enables the catch 32 on the inner wall 30 of the arm to clear the circumferential rim 106, enabling the connector to be decoupled from the gastrostomy device.

FIGS. 6*a-d* illustrate a perspective view of a lock member 200 attached to the first construction of the connector 10. Use of the lock member 200 prevents inadvertent decoupling of the connector from the gastrostomy device.

The lock member includes an annular collar 202 that is slidably received over the second end 14 of the tubular fluid conduit. The collar retains the lock member on the connector. The lock member also includes a generally disk-shaped cover portion 204 that is hingedly attached to the collar.

The lock member 200 includes a flexible tab portion 206 that extends between the cover portion and the collar. The flexible tab portion 206 provides a hinged connection.

A pair of spaced apart hooks 208 depend from a first surface 210 of the cover portion. Each hook 208 is dimensioned such that it is capable of being sandwiched within the gap 27 located between the between the outer wall 26 of the fluid conduit and the inner wall 30 of each arm 20 of the connector.

The curved end 212 of each hook 208 is configured to hook around at least a part of each flexible bridge 28.

Figure 6A:
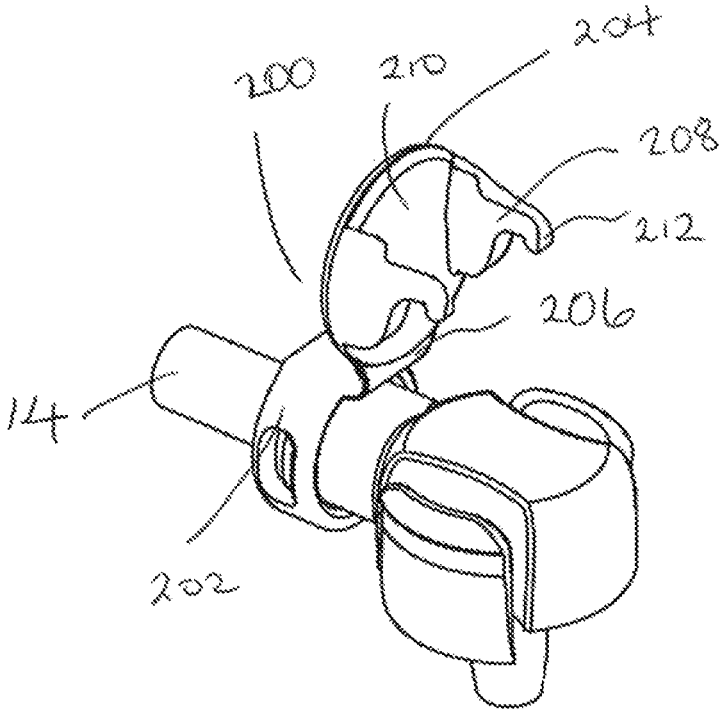
FIGS. 6*a-d*: Illustrate a perspective view of a lock member attached to the first construction of the connector. The lock member is used to prevent the inadvertent decoupling of the connector from the circular port of the gastrostomy device.
Figure 6B:
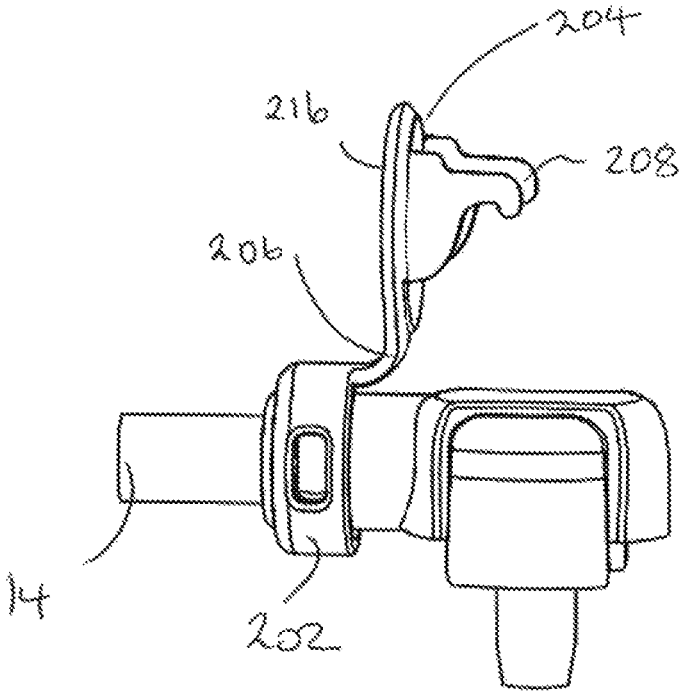

As shown in FIGS. 6*a*-6*b*, the lock member 200 is molded as a unitary plastic component, with the flexible arm 206 being biased to a position in which the first surface 210 from which the hooks 208 depend is positioned substantially perpendicular to the first end 12 of the tubular fluid conduit, when the connector is not coupled to the gastrostomy device. This biasing is achieved as a result of the flexible tab portion 206 being curved.

Figure 6C:
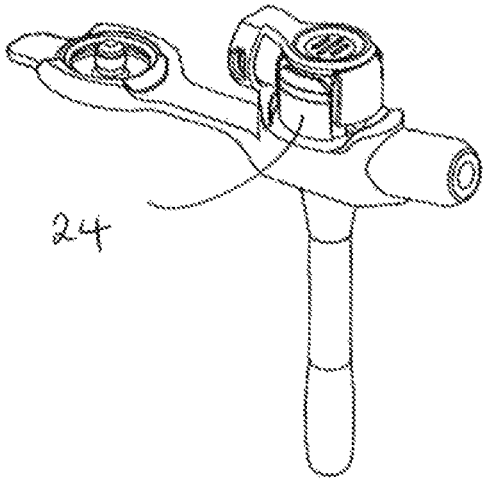
Figure 6D:
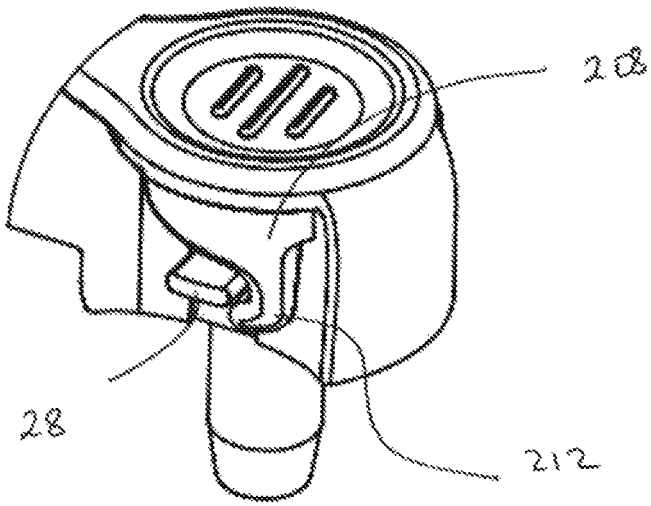

As shown in FIG. 6*b*, once the connector has been connected to the port of the gastrostomy device, and enteral feeding is taking place, the user pushes against the second surface 216 of the cover to rotate the cover by 90° in a clockwise direction. This causes the flexible tab portion 206 to become substantially straight and the hooks 208 are forced into the gap 27. This locked configuration is shown in FIG. 6*c*. In this position, the curved end 212 of each hook becomes hooked around each flexible bridge 28. As shown in FIG. 6*d*.

The hooks 208 act to prevent the second end 24 of each arm 20 being pivoted at the flexible bridge 28, and hence radially displaced out of engagement with the circumferential rim 106 of the circular port. Essentially, each arm is locked in the coupled configuration.

When the user wants to decouple the connector from the gastrostomy device, he/she will grip the cover and rotate it by 90° in an anti-clockwise direction, to its original position.

Figure 7A:
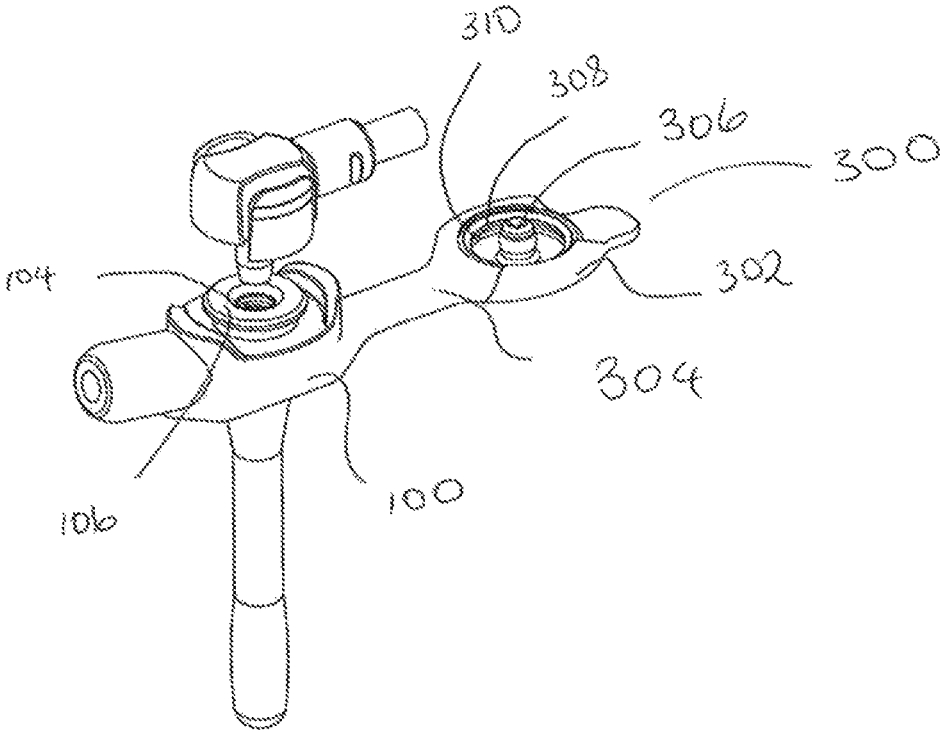
FIGS. 7*a-b*: Illustrate a port closure member for a gastrostomy device. The port is shown in an open configuration in FIG. 7*a*; and a closed configuration in FIG. 7*b;*
Figure 7B:
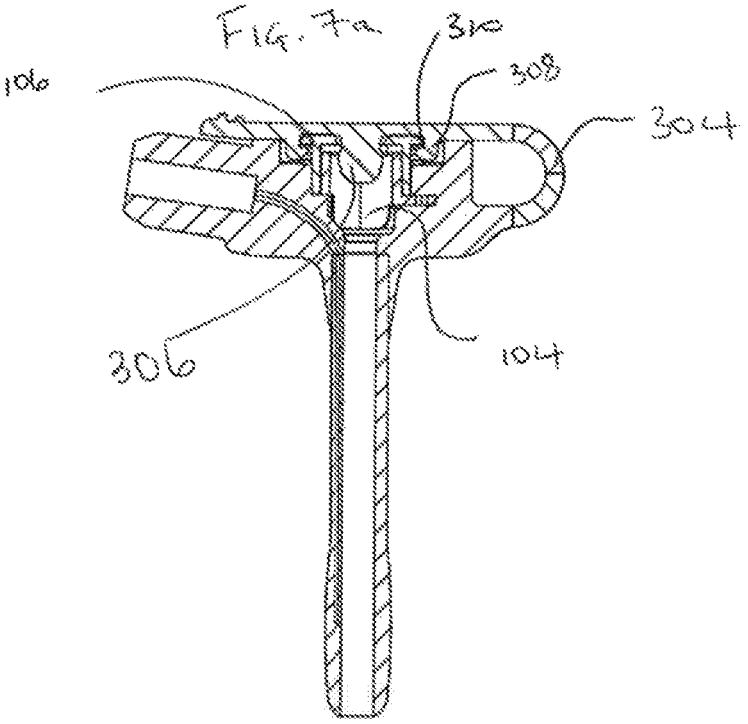

FIGS. 7*a*-7*b* illustrate a perspective view of a port closure member 300 connected to a gastrostomy device 100 according to the third aspect of the invention. FIG. 7*a* shows the circular port 104 open. FIG. 7*b* shows the circular port 104 closed by the port closure member 300. The port is closed when enteral feeding is not taking place.

The port closure member 300 comprises a cap 302 that is tethered by a flexible strip 304 to the gastrostomy device. The cap 302 includes a centrally located, generally cylindrical plug 306 that is dimensioned to be press-fitted into the circular port 104 of the device. This connection forms a fluid-tight seal. The cap also includes a ring member 308 that is radially disposed about the plug 306. The ring member 308 has a circumferential groove 310 dimensioned to receive the circumferential rim 106 provided on the circular port 104 of the gastrostomy device 100. The connection between the circular groove 310 and the circumferential rim 106 is shown in detail in the cross-sectional drawing, FIG. 7*b*.

Figure 8:
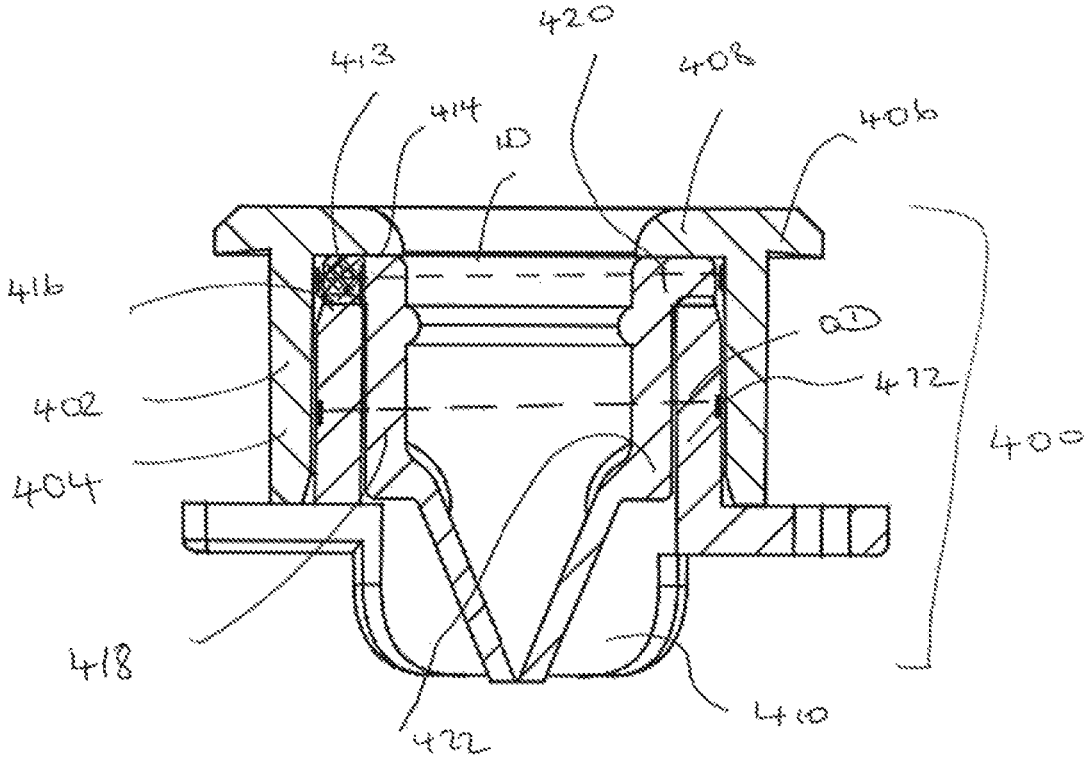
FIG. 8: Illustrates a cross-sectional view of an exemplary construction of a gastrostomy device in which a duckbill valve is inaccessible to the user.
Figure 9:
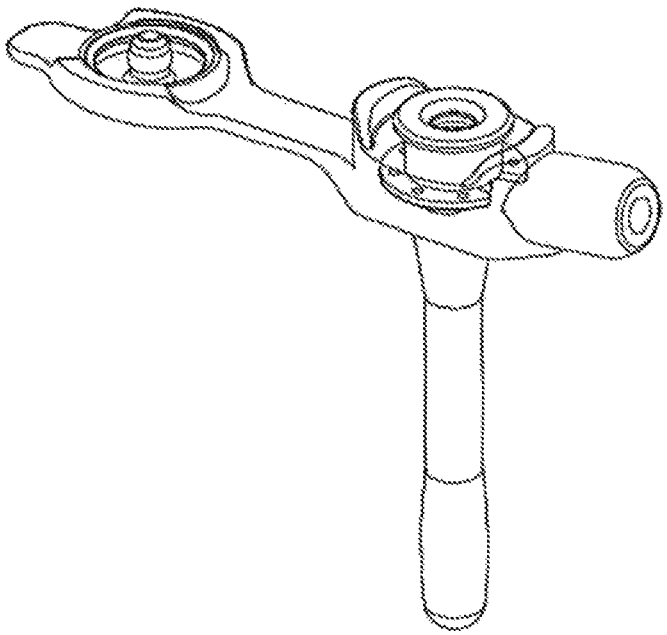
FIG. 9: Illustrates a schematic of the construction shown in FIG. 8.

FIG. 8 illustrates a gastrostomy device according to the fourth aspect of the invention. The circular port assembly 400 of the gastrostomy device 100 consists of an interlock formed by two plastic components that are connected together. For example, the components may be ultrasonically welded together, or connected via a press-fit. A non-return duckbill valve is trapped within the assembly.

The assembly includes a first component 402 that includes a first cylindrical wall member 404 having an inner diameter (ID) and a circumferential rim 406, a portion 408 of which extends inwardly.

The assembly also includes second component 410 that includes a second cylindrical wall member 412 having an outer diameter (OD). The OD of the second cylindrical wall member 412 is less than the ID of the first cylindrical wall member 404. Accordingly, the second component is nested within the first component.

A gap 413 is provided between a surface 414 of the inwardly extending portion 408 of the circumferential rim 406 of the first component, and an end portion 416 of the second cylindrical wall member 412 of the second component.

The circular port assembly 400 also includes a non-return valve, here shown in the form of a duckbill valve 418. The duckbill valve 418 includes a flange 420 from which elastomeric lips 422 in the shape of a duckbill extend.

During assembly of the port assembly 400, the flange 420 of the duckbill valve is retained within the gap 413 provided between a surface 414 of the inwardly extending portion 408 of the circumferential rim 406 of the first component, and an end portion 416 of the second cylindrical wall member 412 of the second component. As this design locates the flange of the duckbill valve entirely within the interior of the circular port assembly, this prevents access to the flange. This minimises the risk of the user inadvertently causing the inward deflection of the flange, and the consequent opening of the valve.

Although particular constructions of the aspects of the invention have been described, it will be appreciated that many modifications/additions and/or substitutions may be made within the scope of the claimed inventions.

The invention claimed is:

1. A connector for rotatably coupling an enteral feeding solution supply tube to a circular port of a gastrostomy device, the connector comprising:

a fluid conduit having a first end configured for connection with an orifice defined in the circular port to supply the enteral feeding solution to the gastrostomy device, and a second end configured for connection to the enteral feeding solution supply tube, a pair of arms circumferentially arranged around an outer wall of the first end of the fluid conduit, each arm including a first free end and a second free end, wherein the second free end includes a catch configured to releasably engage with a circumferential rim on the circular port, and a flexible bridge extending substantially perpendicularly from the outer wall of the first end of the fluid conduit and connecting each arm to the first end of the fluid conduit and about which the first and second ends of each arm can be pivoted, wherein the connector is couplable to and decouplable from the circular port by pivoting the first and second ends of each arm at the flexible bridge such that the catch on the second free end of each arm is radially displaced into engagement or out of engagement with the circumferential rim, wherein the outer wall of the first end of the fluid conduit and an inner wall of each arm are substantially parallel;

wherein the catch is a ledge located on the inner wall of the arm that projects inwardly towards the first end of the fluid conduit, wherein the ledge has a rim contacting surface configured to releasably engage with a ledge contacting surface of the circumferential rim, wherein the ledge contacting surface of the rim is a sloped surface and the rim contacting surface of the ledge has a complementary sloped surface; and wherein the connector is moulded as a unitary component from a plastic.

2. The connector according to claim 1, wherein the second end of the fluid conduit is substantially perpendicular to the first end of the fluid conduit, wherein the connector includes a lock member comprising:

a collar for connecting the lock member to the second end of the fluid conduit, and a cover portion hingedly attached to the collar, wherein a pair of hooks extend from the cover portion, and wherein the cover portion is biased such that the surface from which the hooks depend is substantially perpendicular to the second end of the fluid conduit.

3. A feeding extension set comprising:

an enteral feeding solution supply tube, a connector configured for rotatably coupling the enteral feeding solution tube to a circular port of a gastrostomy device, the connector comprising:

a fluid conduit having a first end configured for connection with an orifice defined in the circular port to supply the enteral feeding solution to the gastrostomy device, and a second end configured for connection to the enteral feeding solution supply tube, a pair of arms circumferentially arranged around an outer wall of the first end of the fluid conduit, each arm including a first free end and a second free end, wherein the second free end includes a catch configured to releasably engage with a circumferential rim on the circular port, and a flexible bridge extending substantially perpendicularly from the outer wall of the first end of the fluid conduit and connecting each arm to the first end of the fluid conduit and about which the first and second ends of each arm can be pivoted, wherein the connector is couplable to and decouplable from the circular port by pivoting the first and second ends of each arm at the flexible bridge such that the catch on the second free end of each arm is radially displaced into engagement or out of engagement with the circumferential rim, wherein the outer wall of the first end of the fluid conduit and an inner wall of each arm are substantially parallel;

wherein the catch is a ledge located on the inner wall of the arm that projects inwardly towards the first end of the fluid conduit, wherein the ledge has a rim contacting surface configured to releasably engage with a ledge contacting surface of the circumferential rim, wherein the ledge contacting surface of the rim is a sloped surface and the rim contacting surface of the ledge has a complementary sloped surface; and wherein the connector is moulded as a unitary component from a plastic.

4. A method of delivering an enteral fluid to a patient comprising the steps of:

using a connector, the connector comprising:

a fluid conduit having a first end configured for connection with an orifice defined in the circular port to supply the enteral feeding solution to the gastrostomy device, and a second end configured for connection to the enteral feeding solution supply tube, a pair of arms circumferentially arranged around an outer wall of the first end of the fluid conduit, each arm including a first free end and a second free end, wherein the second free end includes a catch configured to releasably engage with a circumferential rim on the circular port, and a flexible bridge extending substantially perpendicularly from the outer wall of the first end of the fluid conduit and connecting each arm to the first end of the fluid conduit and about which the first and second ends of each arm can be pivoted, wherein the connector is couplable to and decouplable from the circular port by pivoting the first and second ends of each arm at the flexible bridge such that the catch on the second free end of each arm is radially displaced into engagement or out of engagement with the circumferential rim, wherein the outer wall of the first end of the fluid conduit and an inner wall of each arm are substantially parallel;

wherein the catch is a ledge located on the inner wall of the arm that projects inwardly towards the first end of the fluid conduit, wherein the ledge has a rim contacting surface configured to releasably engage with a ledge contacting surface of the circumferential rim, wherein the ledge contacting surface of the rim is a sloped surface and the rim contacting surface of the ledge has a complementary sloped surface; and wherein the connector is moulded as a unitary component from a plastic, coupling the first end of the fluid conduit to the circular port of an indwelling gastrostomy device, coupling the second end of the fluid conduit to an enteral feeding solution supply tube.

5. The method of delivering an enteral fluid to a patient according to claim 4, wherein the second end of the fluid conduit of the connector is substantially perpendicular to the first end of the fluid conduit of the connector, wherein the connector includes a lock member comprising:

a collar for connecting the lock member to the second end of the fluid conduit, and a cover portion hingedly attached to the collar, wherein a pair of hooks extend from the cover portion, wherein the cover portion is biased such that the surface from which the hooks depend is substantially perpendicular to the second end of the fluid conduit, wherein the method further comprises the step of positioning the pair of hooks on the lock member around at least part of each flexible bridge to prevent the second free end of each arm from decoupling from the circumferential rim.

* * * * *